United States Patent [19]

Ottestad

[11] Patent Number: 4,783,123

[45] Date of Patent: Nov. 8, 1988

[54] TOOL BIT FOR IMPACT RIPPING OF A MINE FACE

[76] Inventor: Jack B. Ottestad, 1442 Muirlands Dr., La Jolla, Calif. 92037

[21] Appl. No.: 946,417

[22] Filed: Dec. 23, 1986

[51] Int. Cl.[4] ..... E21B 10/36

[52] U.S. Cl. ..... 299/94; 175/414; 175/405; 294/55

[58] Field of Search ..... 299/86, 89, 94, 69; 174/405, 414, 415, 416; 37/141 T; 7/144; 81/20, 25; 30/164.6, 164.5; 294/55; 83/875; 408/144, 145, 203.5

[56] References Cited

U.S. PATENT DOCUMENTS

| | | | |
|---|---|---|---|
| 1,174,433 | 3/1916 | Mowlds | 299/91 |
| 1,636,604 | 7/1927 | Hansen | 299/88 |
| 2,549,088 | 4/1951 | Hettelsater | 299/89 X |
| 2,565,528 | 8/1951 | Sloane | 299/94 X |

FOREIGN PATENT DOCUMENTS

| | | | |
|---|---|---|---|
| 1370084 | 7/1964 | France | 299/89 |
| 381744 | 8/1973 | U.S.S.R. | 175/416 |

*Primary Examiner*—Stephen J. Novosad
*Assistant Examiner*—David J. Bagnell
*Attorney, Agent, or Firm*—Donald D. Mon

[57] ABSTRACT

A percussive tool, and a tool bit for the percussive tool for cutting the face of a deposit to be extracted. The tool bit is a circularly cylindrical columnar structure driven axially by the percussive tool. It is laterally unsupported and unobstructed for a substantial reference length. It has a circular cutting edge whose outer diameter increases as it extends axially away from its cutting end. Its ratio of wall thickness to outer diameter, and reference length to wall diameter, are such as to resist permanent lateral deformation and euler-type columnar collapse. When mounted, the bit is rotatable around its own central axis.

12 Claims, 1 Drawing Sheet

TOOL BIT FOR IMPACT RIPPING OF A MINE FACE

FIELD OF THE INVENTION

This invention relates to a tool bit for impact ripping of a mine face to remove material, for example rock or coal, from the face.

BACKGROUND OF THE INVENTION

Minerals to be extracted are generally removed from the exposed face of a deposit. The face may, for example, be the wall or the end of a tunnel, stope room, or bore. When the generation of gases is not objectionable, it is common practice to drill holes in a working face, place dynamite in it, blast the face to rubble, and remove the rubble. Frequently, and especially in very deep mines, the generation of gases from blasting is intolerable, and percussive impact techniques are used instead.

When percussive techniques are used, a tool bit is struck by a hammer mechanism, and is thereby driven against and into the face to fracture and dislodge material from it. These techniques are widely used, and there are many tool bits for the purpose.

Existing tool bits suffer from a number of inherent disadvantages, and themselves raise problems for the systems in which they are used. For example, the working room available in many important mines is often very limited. As an example, in gold mines where a vein of rather small thickness is to be extracted, the headroom may be very low. Tools used in such environments are often mounted so that they move along an arc, while their support vehicle crawls along a directed path. In the course of this scoop-like movement, the tool bit is driven against the face to fracture it. A percussive hammer delivers successive blows to the base of the bit. These hammers have substantial axis and lateral dimensions, and the tool bit itself adds significantly to the axial length of the assembled tool and bit.

Material on the face is most advantageously removed by a chipping action in which a blow is delivered at an acute angle to the face. There are considerable potential advantages in making this angle as small as possible, but existing tools render this difficult to the point of practical impossibility. Consider the use of a spike-like single point bit on the central axis of the tool. If the bit is relatively short, then the tool body strikes the mine face within a relatively small angle from the normal to the face. The "cure" for this problem is to elongate the bit, but then the assembly of tool and bit becomes so long as to be unwieldy in many mining situations, and the bits must be made very heavy. Furthermore, the blows are delivered at a single point, which action does not optimally dislodge the face material and is subject to rapid wear. For all of its faults, this arrangement is widely used, because on balance it has the fewest drawbacks in the state of the art as it exists prior to this invention.

One could surmise that a spade-like bit could overcome at least the disadvantage of such a localized exertion of force. However, to resist the resulting substantial banding loads, this type of bit must also be made quite heavy. Worse still, because the rock face is irregular, one edge can dig in before the other, and as the tool is driven, a twisting torque is exerted which either bends or breaks the tool bit, or if the bit survives, the twisting force is exerted through to the tool to the extent that it can actually up-end the tool assembly and turn it over. Spade-like tools are not suitable.

In addition to the foregoing problems, it is inherent in conventional digging type tools that at the very point of impact where they are most heavily loaded, coolant gases or liquids cannot reach into the pocket created by the tool. Thus, at the point of maximum stress, the tool is subjected to the highest temperatures, and this leads to greatly increased tool wear.

A tool bit according to this invention is not only axially shorter than a conventional center-spike tool must be, but can be made so short as to enable the angle of attack to be importantly smaller than was before attainable. It also enables a scoop-like blow to be given without exertion of a twisting torque on the system. As a consequence, scoop-type impact can be delivered by a machine with importantly reduced axial length and reduced interference.

Because this tool is rotated during usage, it continually presents to the working face a fresh and cooled cutting edge. Each length of cutting edge is steadily replaced, so there is no significant temperature build-up. The tool life is greatly extended. Further, a circular configuration is much more resistant to bending forces than a spade.

Examples of mining operations in which this invention provides important advantages are in the extraction of quartzite gold ores, and in coal deposits wherein the coal itself is so close to layers of shale that a mixed product results which would tend to destroy conventional toothed mining machinery.

BRIEF DESCRIPTION OF THE INVENTION

A tool bit according to this invention is a metal body with a central axis. It is adapted to be mounted to a percussion tool to transmit an axial blow given to it by the tool. The bit is also rotatably mountable to the percussion tool. At its free end it has a circular cutting edge. Along a reference length from its free end it is a columnar structure without side support. Along that length it is physically unobstructed along its side over at least about one-half of its circumference (side exposure). The bit is a body of revolution throughout its reference length.

The ratio between the reference length and the outer diameter is such as to resist columnar failure, even from eccentric axial loads delivered only atone side of the cutting edge. The wall thickness and the diameter are such as to resist lateral collapse and permanent lateral deformation. In its preferred embodiment, the tool bit along its reference length is a cylinder.

The above and other features of this invention will be fully understood from the following detailed description and the accompanying drawings, in which:

DETAILED DESCRIPTION OF THE INVENTION

This invention relates to operations of types in which material is removed from a working face by impact forces. The most common such operations are in the mining field. Such working faces in a mine may, for example, be the advancing face of a tunnel or bore, or the wall of an existing tunnel, bore, or stope room.

Figure 1:
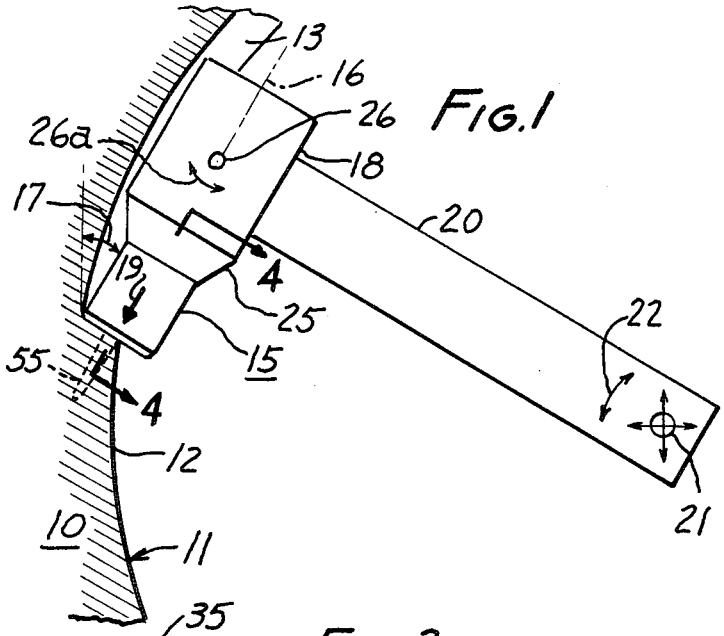
FIG. 1 is a top view of a system according to the invention.
Figure 2:
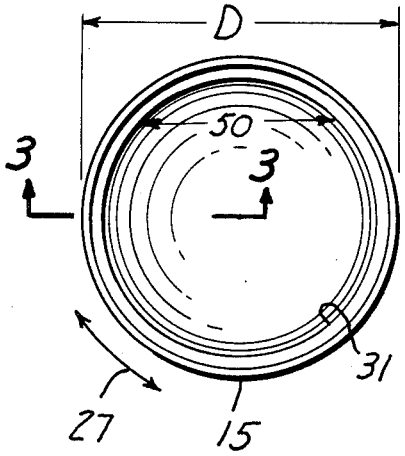
FIG. 2 is an end view taken at line 2—2 in FIG. 1.

FIG. 1 shows a body 10 of material to be extracted. A working face 11 is shown with a region 12 about to be worked, and a groove 13 from which material has just been removed.

A tool bit 15 is shown in engagement with the working face. It has a central axis 16 directed toward the cutting face at an acute angle 17. It is percussively driven axially by a percussion tool 18, for example a hydraulically impact driven hammer, whose delivered force is exemplified by arrow 19. Tool 18 may be any desired type of hammer that delivers sequential blow.

In a preferred mining system, tool 18 is mounted to an arm 20 that swings in a plane around and normal to central axis 21. The location of the axis can be moved, such as by mounting the system to ways, rails, or carriages (not shown), so that it can be moved toward and along the face. It will swing in an arc exemplified by arrow 22. The tool itself is mounted to an axle (not shown) carried by the arm, so that it can be pivoted around axis 26 along an arc 26*a*. In addition, it can be mounted for pivoting movement in an up and down direction in a plane normal to the sheet of FIG. 1.

Of foremost importance is the orientation of axis 16 relative to the working face. This may be adjusted by rotating the hammer around axis 26, which represents an axle or shaft mounted to arm 20. Axes 21 and 26 are parallel to one another. Depending on the nature of the material being cut, angle 17 may be as small as 22 degrees. It will rarely be greater than 45 degrees because a smaller angle can provide better chipping-type removal of material. It is also a convenience to be able to move the point of attachment of the tool itself to the arm, along axis 16.

Figure 3:
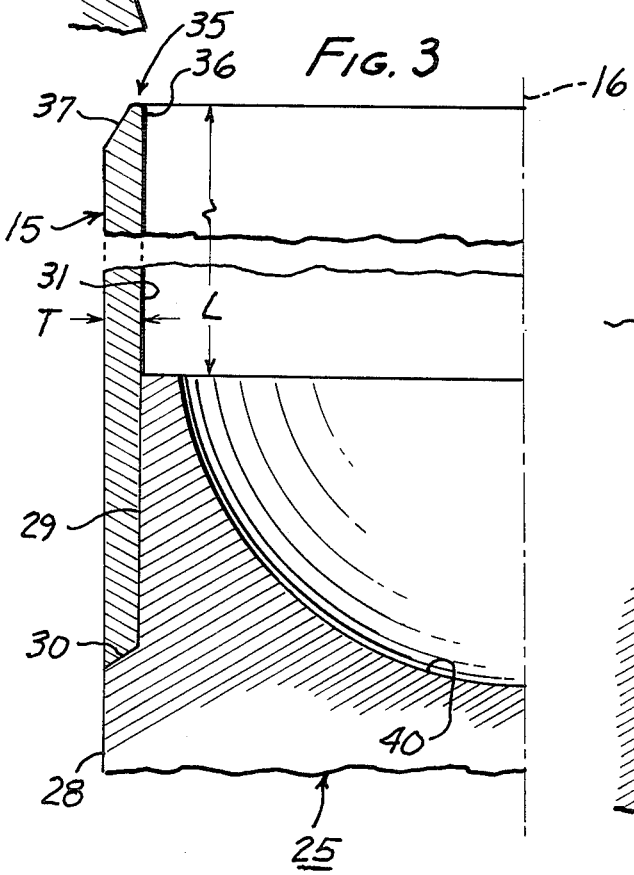
FIG. 3 is a section taken at line 3—3 in FIG. 2.

Tool bit 15 is mounted to the percussion tool by mount means 25, which mount means is shown schematically in FIG. 3. Tool 18 terminates in a mount means 25 which is rotatably supported on the tool by bearing means (not shown). Mount means 25 (see FIG. 3) means includes a central block 28 which has a tapered side 29 and a stop shoulder 30. The tool bit may have a purely cylindrical or slightly tapered inner wall 31. In either event, the bit is driven onto the block to make an interference fit, which is limited when the end of the bit abuts shoulder 30. This is a convenient means to fix the bit to the mount. The tool bit is a hollow body of revolution developed around its central axis. It has a circular cutting edge (or end) 35 which in use soon becomes and remains bluntly pointed. The edge that is developed in use generally has an inside radius 36 and a outside surface 37 as shown in FIG. 3, and the continual wear on it generates this advantageous shape.

Mount means 25 is mounted to the tool by bearing means (not shown) so that it rotates with the bit, another way of saying that the tool bit is rotatably mounted to the tool.

The tool bit has a "reference length" (L), which is a length measured from its cutting edge to where it is side-supported by the block. Along the reference length it is not side supported. In addition, it is free of lateral obstruction around at least one-half of its circumference so there will be no impediment to limit its access to the working face. Preferably there is no impediment at all along the reference length.

The tool bit has an outside diameter (D) and a wall thickness (T). These reference dimensions are given for a pure cylinder. It is, of course possible to vary the wall thickness along the length, perhaps to reinforce the cutting end, but in a properly proportioned bit this is not cost effective.

The mount means has a rounded dish-like bottom 40. This shape aids in keeping the tool clear of debris. Debris which strikes it is returned toward the cutting end.

The material of the bit should be a steel which cold works but which can be gradually abraded. A chormium-nickel alloy such as 4142 is suitable. When such an alloy is used, radius 36 and surface 37 are developed by abrasive contact with the working face. The outside surface is developed by abrasive contact with a lip of face material formed by the cutting action of the tool. The somewhat rounded sharp end is quite suitable for most purposes, and does not require sharpening or resharpening for most uses.

The proportions of the tool bit are important to its function and longevity. The bit is pressed against and along the face, so the resultant force is an axial one exerted against the cutting edge eccentrically on the columnar bit, and a side load which tends to deform the bit and deflect it sidewardly. The latter also increases the eccentric load on the bit. The dimensions and their relationships to one another, especially L/D, and D/T are selected such that the column, acting as an euler column, does not collapse in the sense of buckling or bending. In addition, the ratio of D/T must be such as to resist permanent lateral deformation. There may be some distortion of the cutting edge, but not so much as significantly to impede the cutting action, or to result in a permanently deformed cutting end. The circular section assists in resisting permanent deformation.

The actual dimensions of such bits, and even the basic parameters, including the alloy and its physical properties will be determined by trial. Speaking generally, the diameter of the bit will be such that chord 50, which represents a theoretical surface of the working face when attacked by the bit, will be large enough to be commercially important. For many applications, D will equal about 10 inches, and the chord will be about 6 inches to 8 inches. This is the "swath" of the channel being cut into the working face. Of course its depth is greater at its center than at its edges. For such a bit, a wall thickness of about ¾ inches is suitable and appears to be optimal. The reference length L at most will be about 15 inches, and preferably will be about 6 inches. These examples are for 4142 material.

Speaking broadly, a L/D ratio between about 0.2 and about 1.5 is best. Above this ratio, the bit tends to be subject to undesirable distortions. Lesser ratios do not provide an adequate length.

The angle of attack is advantageously kept as small as possible because this speeds up the traverse of the faceand improves the chipping action. This is dependent in part on the properties of the deposit being attacked, because best fracturing and a suitable depth of penetration as a function of the power available to the tool may require a larger or smaller angle. The miner will soon adjust this angle to obtain best results.

The bit rotates in use, so that it will wear relatively uniformly around its cutting edge, and not tend to settle into one alignment. Because of this there will be no twisting force exerted on the tool bit, or on the percussive tool or its supports. In operation, this tool is vigorous, and no positive means need to be provided to rotate the bit. It simply rotates by itself. Of course means could be provided to rotate it, such as by way of a ring gear drive.

There is yet another advantage. Percussive bits exert their forces in confined regions which they dig, where cooling is inefficient if it happens at all. This leads to higher tool temperatures and accelerated tool wear. Because this bit rotates, a new and cooler cutting surface continually arrives at the face, and tool wear is decreased.

The geometrical advantages of this tool system relative to its surroundings are shown in FIG. 1. For comparison, there is shown in dashed line a single point tool bit 55 having the axial length necessary to cut a groove as deep as is being cut by the cylindrical cutter shown in solid line. Notice that the single point bit projects axially far beyond the latter, and thereby would increase the total length of the assembly. Now observe the points where the bit 15 cuts and the tool 18 would strike the face. If the single-point tool bit were to be as short as the cylindrical tool bit instead of as long as the theoretical bit 55, then a much larger angle of incidence would be required. Thus, the cylindrical tool at once enables a shorter tool assembly, and one which can attack the face at a lesser angle.

The cylindrical tool bit is useful at all useful approach angles. Because it is a uniformly circular body it still functions well regardless of the angle, and the tool bit can be scanned repetitively across the face, varying the angle from pass to pass, and even up and down. Ultimately the supporting mechanism will be moved.

Because the tool is scoop-shaped, it discharges the rubble ahead of itself, and is self-clearing. The dish-shaped bottom in the mount assists with this self-clearing.

Figure 4:
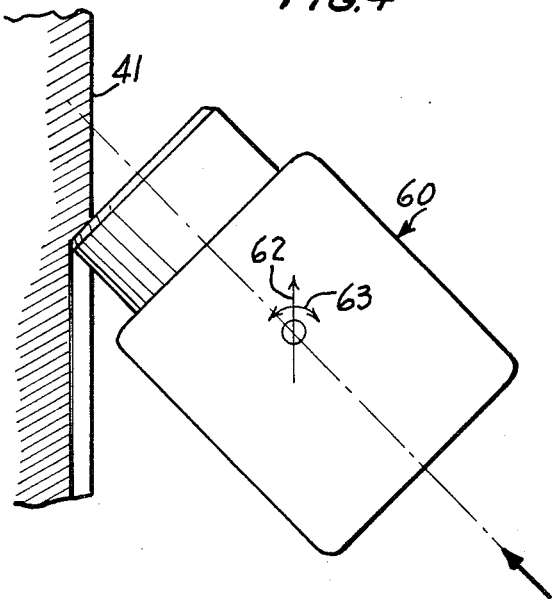
FIG. 4 is a schematic view showing another system according to the invention.

FIG. 4 illustrates that the tool 60 need not be mounted to a swinging arm. Instead it may be directly carriage mounted and moved in a straight pass across a face 41 as shown by arrow 62, and can be adjusted as shown by arrow 63. In addition, it can be tilted up and down as in FIG. 1.

The tool bit is surprisingly convenient to use, and is able to work on mixed materials which have frustrated known devices. For example, a mixture of soft coal and hard shale frequently breaks teeth and cogs of known devices. By contrast, when the bit of this invention is used, the effect instead is principally to sharpen the tool.

This invention is not to be limited to the embodiments shown in the drawings and described in the description, which are given by way of example and not of limitation, but only in accordance with the scope of the appended claims.

I claim:

1. A tool bit to receive percussive blows for cutting into the face of a deposit to be extracted, said bit comprising: a metal body having a central axis, a base end and a cutting end, said body being a body of revolution having a outer wall; and inner wall; an outside diameter (D); an inside diameter; and a wall thickness (T); said walls being coaxial; said base end being adapted to be mounted to a percussive tool which delivers axial blows to said tool bit; said bit, along a reference length (L) extending from its cutting end to a place of lateral support being a tubular columnar structure unsupported from its side for a substantial distance from its cutting end, and physically unobstructed over substantially its entire reference length for at least about half of its side exposure; said cutting end being circular and exposed sufficiently to deliver axial scooping blows to said face; the ratio (L/D) of said reference length to said outside diameter being selected such that the bit, acting as an euler column does not collapse under the axial blows in the sense of buckling or bending; the ratio (T/D) if said wall thickness to said outside diameter being sufficient to resist permanent lateral deformation along said reference length; said outer diameter increasing gradually from the cutting end for an axial distance less than said reference length; said inside diameter being substantially constant along that same axial distance.

2. A tool bit according to claim 1 in which said (L/D) ratio is on the order of between about 0.2 and 1.5.

3. A tool bit according to claim 1 in which said (T/D) ratio is between about 0.05 to 0.1.

4. A tool bit according to claim 3 in which said (L/D) ratio is on the order of between about 0.2 and 1.5.

5. In combination, a percussion tool having a driving axis along which it delivers repetitive axial blows; a tool bit for cutting into the face of a deposit to be extracted, said bit comprising a metal body having a central bit axis coincided with said driving axis; a base end and a cutting end, said body being a body of revolution having an outer wall; an inner wall; an outside diameter (D); an inside diameter and a wall thickness (T); said walls being coaxial; said base end being adapted to be mounted to a percussive tool which delivers axial blows to said tool bit, said bit, along a reference length (L) extending from its cutting end to a place of lateral support being a tubular columnar structure unsupported from its side for a substantial distance from its cutting edge, and physically unobstructed over substantially its entire reference length for at least about half of its side exposure, said cutting end being circular and exposed sufficiently to deliver axial scooping blows to said face; and mount means mounting said tool bit to said percussive tool so that the driving axis and the bit axis are coincident in such a way that the percussive blows are delivered to said base end, and in turn are transmitted by the said cutting end; the ratio (L/D) of said reference length to said outside diameter being selected such that the bit, acting as an euler column does not collapse under the axial blows in the sense of buckling or bending; the ratio (T/D) of said wall thickness to said outside diameter being sufficient to resist permanent lateral deformation along the reference length; said outer diameter increasing gradually from the cutting end for an axial distance less than said said reference length; said inside diameter being substantially constant along that same axial distance.

6. A combination according to claim 5 in which said (L/D) ratio is on the order of between about 0.2 and 1.5.

7. A combination according to claim 5 in which said (T/D) ratio is between about 0.05 to 0.1.

8. A combination according to claim 7 in which said (L/D) ratio is on the order of between about 0.2 and 1.5.

9. A combination according to claim 5 in which said mount means comprises a central body having an external wall and a shoulder, said tool bit, the external wall and shoulder being so proportioned and arranged that the tool bit can be driven onto the body to make an interference fit and to abut said shoulder to limit its axial movement along said external wall and to provide internal lateral support for the tubular bit away from said cutting end;

10. A combination according to claim 9 in which said external wall is tapered to provide said interference, the internal wall of the tool bit in that position of its length in said interference having been a right circular cylinder before being driven onto the mount.

11. A combination according to claim 9 in which said mount has a dish-like bottom to tend to return material removed from the face of the deposit toward the cutting end of the bit.

12. A combination according to claim 11 in which said external wall is tapered to provide said interference, the internal wall of the tool bit in that position of its length in said interference, having been a right circular cylinder before being driven onto the mount.

* * * * *